US011718456B2

(12) United States Patent
Shen et al.

(10) Patent No.: US 11,718,456 B2
(45) Date of Patent: Aug. 8, 2023

(54) CHILD-RESISTANT CLOSURE SYSTEM

(71) Applicant: Yuan Ding International (Shanghai) Co., Ltd., Shanghai (CN)

(72) Inventors: Haowei Shen, Shanghai (CN); Zhengqiang Xie, Shanghai (CN)

(73) Assignee: YUAN DING INTERNATIONAL (SHANGHAI), CO., LTD, Shanghai (CN)

( * ) Notice: Subject to any disclaimer, the term of this patent is extended or adjusted under 35 U.S.C. 154(b) by 171 days.

(21) Appl. No.: 17/074,402

(22) Filed: Oct. 19, 2020

(65) Prior Publication Data

US 2021/0114782 A1 Apr. 22, 2021

Related U.S. Application Data

(60) Provisional application No. 62/923,153, filed on Oct. 18, 2019.

(51) Int. Cl.

| | |
|---|---|
| ***B65D 50/04*** | (2006.01) |
| ***B65D 33/16*** | (2006.01) |
| ***B65D 33/00*** | (2006.01) |

(52) U.S. Cl.

CPC ..... *B65D 50/046* (2013.01); *B65D 33/007* (2013.01); *B65D 33/1683* (2013.01)

(58) Field of Classification Search

CPC . B65D 50/046; B65D 33/007; B65D 33/1683

(Continued)

(56) References Cited

U.S. PATENT DOCUMENTS 4,905,298 A * 2/1990 Walor ..... B65D 33/16 383/95
5,235,731 A * 8/1993 Anzai ..... A44B 18/0053 24/DIG. 39

(Continued)

FOREIGN PATENT DOCUMENTS

CN 2431229 5/2001
CN 108577109 9/2018

(Continued)

OTHER PUBLICATIONS

Child Resistant Bag, https://www.impakcorporation.com/flexible packaging/child-resistant-pouch/cr-slider/7PCR08506W, Aug. 16, 2021.

(Continued)

*Primary Examiner* — Peter N Helvey
(74) *Attorney, Agent, or Firm* — Sheppard Mullin Richter & Hampton, LLP

(57) ABSTRACT

A child-resistant resealable container comprising a closure strip assembly having first and second lateral interlocking members. The first lateral interlocking member is attached to a first extension strip, and the second lateral interlocking member is attached to a second extension strip. The first and second extension strips are attached to the interior surfaces of the respective first and second walls below the top edge of the first and second walls such that a portion of the first and second walls extends to define first and second flaps. The first and second lateral interlocking members are configured to become disengaged from each other when the first flap and the second flap are pulled apart from each other as the first flap is gripped while the first extension strip is not gripped and the second flap is gripped while the second extension strip is not gripped.

20 Claims, 8 Drawing Sheets

(58) Field of Classification Search
USPC ..... 383/35, 63, 61.2
See application file for complete search history.

(56) References Cited

U.S. PATENT DOCUMENTS

| | | | | |
|---|---|---|---|---|
| 5,398,387 | A * | 3/1995 | Torigoe | A44B 18/0053 24/452 |
| 5,931,582 | A * | 8/1999 | Nichols | B65D 33/2541 383/65 |
| 6,231,236 | B1 * | 5/2001 | Tilman | B65D 33/2566 383/103 |
| 6,367,128 | B1 * | 4/2002 | Galkiewicz | A44B 18/0053 24/584.1 |
| 6,546,604 | B2 * | 4/2003 | Galkiewicz | A44B 18/0092 24/584.1 |
| 7,506,487 | B2 | 3/2009 | Eads et al. | |
| 7,674,039 | B2 * | 3/2010 | McMahon | B65D 33/2566 383/103 |
| 9,015,910 | B2 * | 4/2015 | Septien Rojas | A44B 19/16 24/399 |
| 10,011,403 | B1 * | 7/2018 | Kirsh | B65D 33/2566 |
| 10,427,839 | B2 | 10/2019 | Johnston | |
| 11,292,638 | B2 * | 4/2022 | Hansen | B65D 33/2508 |
| 2012/0045151 | A1 * | 2/2012 | Eouzan | B65D 33/2541 383/42 |
| 2014/0161374 | A1 * | 6/2014 | Septien Rojas | B65D 33/2541 383/63 |
| 2015/0336713 | A1 | 11/2015 | Gum | |
| 2017/0190476 | A1 * | 7/2017 | Goto | B65D 33/2566 |
| 2018/0312301 | A1 * | 11/2018 | Martial | B65D 33/2541 |
| 2018/0312302 | A1 | 11/2018 | Septien Rojas et al. | |
| 2018/0319546 | A1 * | 11/2018 | Liu | B65D 33/2508 |

FOREIGN PATENT DOCUMENTS

| | | |
|---|---|---|
| CN | 109071070 | 12/2018 |
| DE | 102015121540 | 6/2017 |
| EP | 3693288 | 8/2020 |
| WO | WO2014066025 | 5/2014 |
| WO | WO2019028216 | 2/2019 |

OTHER PUBLICATIONS

Bag with a Childproof Locking System, http://www.leaderflexible.com/product-detail/child-resistant-bag-child-proof-bag-marijuana-bag/, Aug. 16, 2021.
Child-Resistant Locking Pouches, https://www.clearbags.com/bags/child-resistant, Aug. 16, 2021.
Child Resistant Bags, https://stinksack.com/product-category/child-resistant/, Aug. 16, 2021.
Child Resistant Exit Bags, https://420stock.com/product/12x9-child-resistant-exit-bags/, Aug. 16, 2021.
Pinch n Slide, http://www.pinchnslide.com/, Aug. 16, 2021.
Child-Resistant Thumb-Pocket Zipper Bag, https://www.impakcorporation.com/flexible_packaging/child-resistant-pouch/thumb-pocket/ZCR0550675TE, Aug. 16, 2021.

* cited by examiner

CHILD-RESISTANT CLOSURE SYSTEM

CROSS-REFERENCE TO RELATED APPLICATIONS

This application claims priority to U.S. Provisional Patent Application No. 62/923,153, filed Oct. 18, 2019, which is hereby incorporated by reference in its entirety as if fully set forth herein.

FIELD OF THE INVENTION

The disclosed technology relates generally to resealable containers and, more particularly, to resealable containers having a child-proof or child-resistant closure mechanism.

BACKGROUND

Flexible packaging bags with resealable zipper closures are widely available for holding a variety of products. Zipper closures on conventional bags can be easily opened and are not appropriate for use with medicines and other potentially hazardous substances. Existing child-proof zipper systems are overly complicated and can be difficult and expensive to manufacture. It should be appreciated that there is a need for an improved child-resistant closure system. The present invention fulfills this need and provides further related advantages.

BRIEF SUMMARY OF THE INVENTION

The present invention is embodied in a resealable container comprising a first wall, a second wall, a first extension strip, a second extension strip, and a closure strip assembly. In one embodiment, the first and second walls can be sealed together along respective side edges and a bottom edges of the first and second walls such that interior surfaces of the first and second walls form a storage space therebetween. In another embodiment, a top edge of the first wall and a top edge of the second wall define an opening for the storage space.

In one embodiment, the first extension strip can have a first edge and a second edge. In another embodiment, the first edge of the first extension strip can be attached to the interior surface of the first wall below the top edge of the first wall such that a portion of the first wall extends from the first edge of the first extension strip to the top edge of the first wall to define a first flap. In a further embodiment, the second edge of the first extension strip can be positioned between the first edge of the first extension strip and the top edge of the first wall.

In one embodiment, the second extension strip can have a first edge and a second edge. In another embodiment, the first edge of the second extension strip can be attached to the interior surface of the second wall below the top edge of the second wall such that a portion of the second wall extends from the first edge of the second extension strip to the top edge of the second wall to define a second flap. In a further embodiment, the second edge of the second extension strip can be positioned between the first edge of the second extension strip and the top edge of the second wall.

In one embodiment, the closure strip assembly can comprise a first lateral interlocking member and a second lateral interlocking member. In another embodiment, the first lateral interlocking member can be operatively connectable to the second lateral interlocking member. In a further embodiment, the first lateral interlocking member can be attached to the first extension strip above the first edge of the first extension strip and below the second edge of the first extension strip, and the second lateral interlocking member can be attached to the second extension strip above the first edge of the second extension strip and below the second edge of the second extension strip.

In an embodiment, the first and second lateral interlocking members can be configured to remain operatively connected when the first flap and the second flap are pulled apart while gripping the first flap together with the first extension strip and while gripping the second flap together with the second extension strip so as to cause the second edges of the first and second extension strips to be pulled apart from each other. In another embodiment, the first and second lateral interlocking members can be configured to become disengaged from each other when the first flap and the second flap are pulled apart from each other as the first flap is gripped while the first extension strip is not gripped and the second flap is gripped while the second extension strip is not gripped so as to cause the first edges of the first and second extension strips to be pulled apart from each other. In yet another embodiment, the first and second lateral interlocking members can be configured to become disengaged from each other when the first and the second flaps are gripped below the closure strip assembly.

In one embodiment, when the first flap and the second flap are pulled apart from each other as the first flap is gripped while the first extension strip is not gripped and the second flap is gripped while the second extension strip is not gripped so as to cause the first edges of the first and second extension strips to be pulled apart from each other, outward opening force can be concentrated at the bottom portion of the first lateral interlocking member and the bottom portion of the second lateral interlocking member such that relative rotation between the first lateral interlocking member and the second lateral interlocking member is maximized. In yet another embodiment, when the first flap and the second flap are pulled apart while gripping the first flap together with the first extension strip and while gripping the second flap together with the second extension strip so as to cause the second edges of the first and second extension strips to be pulled apart from each other, outward opening force can be concentrated at the top portion of the first lateral interlocking member and the bottom portion of the second lateral interlocking member such that relative rotation between the first lateral interlocking member and the second lateral interlocking member is minimized.

In one embodiment, the first lateral interlocking member can comprise a top portion and a bottom portion opposite the top portion of the first lateral interlocking member. In another embodiment, the first lateral interlocking member can be attached to the first extension strip at both the top and bottom portions of the first lateral interlocking member.

In one embodiment, the second lateral interlocking member can comprise a top portion and a bottom portion opposite the top portion of the second lateral interlocking member. In another embodiment, the second lateral interlocking member can be attached to the second extension strip at the bottom portion of the second lateral interlocking member. In a further embodiment, the top portion of the second lateral interlocking member can be rotatable.

In one embodiment, the first lateral interlocking member can comprise at least three asymmetrical female strips. In another embodiment, the second lateral interlocking member can comprise at least three asymmetrical male strips. In a further embodiment, the first lateral interlocking member can comprise at least three female interlocking channels. In an additional embodiment, the second lateral interlocking member can comprise at least three male interlocking beads.

In one embodiment, at least one of the at least three asymmetrical female channels can comprise a first J-shaped member. In another embodiment, at least one of the at least three asymmetrical male beads comprises a second J-shaped member. In a further embodiment, the first J-shaped member can face the top edge of the first wall. In additional embodiment, the second J-shaped member can face the bottom edge of the second wall.

In one embodiment, the first J-shaped member can engage the second J-shaped member when the first lateral interlocking member is operatively connected to the second lateral interlocking member. In another embodiment, the first and second lateral interlocking members can be operable to disengage each other when the female interlocking strip is rotated relative to the male interlocking strip so that the first J-shaped member disengages from the second J-shaped member. In a further embodiment, the first and second lateral interlocking members can be operable to disengage each other when the female interlocking strip is rotated relative to the male interlocking strip so that a free end of the first J-shaped member rotates toward the bottom edge of the first wall and a free end of the second J-shaped member rotates toward the bottom edge of the second wall.

In one embodiment, each of the first extension strip and the second extension strip further comprises peripheral segments proximate the respective side edges of the first and second walls, and a central segment between the respective peripheral segments. In another embodiment, the peripheral segments of the first extension strip can be attached to the first wall above the closure strip assembly, and the central segment of the first extension strip is not attached to the first wall above the first edge of the first extension strip. In a further embodiment, the peripheral segments of the second extension strip can be attached to the second wall above the closure strip assembly, and the central segment of the second extension strip is not attached to the second wall above the first edge of the second extension strip.

In one embodiment, a portion of the first extension strip between the first lateral interlocking member and the first edge of the first extension strip is not attached to the first wall. In another embodiment, a portion of the second extension strip between the second lateral interlocking member and the first edge of the second extension strip is not attached to the second wall.

In one embodiment, each of the first wall and the second wall can be a unitary sheet.

In one embodiment, the second edge of the first extension strip is not attached to the interior surface of the first wall. In yet another embodiment, the second edge of the second extension strip is not attached to the interior surface of the second wall.

Each feature or concept outlined above is independent, and can be combined with the other features or concepts outlined above or with any other feature or concept disclosed in this application. Other features and advantages of the invention should become apparent from the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
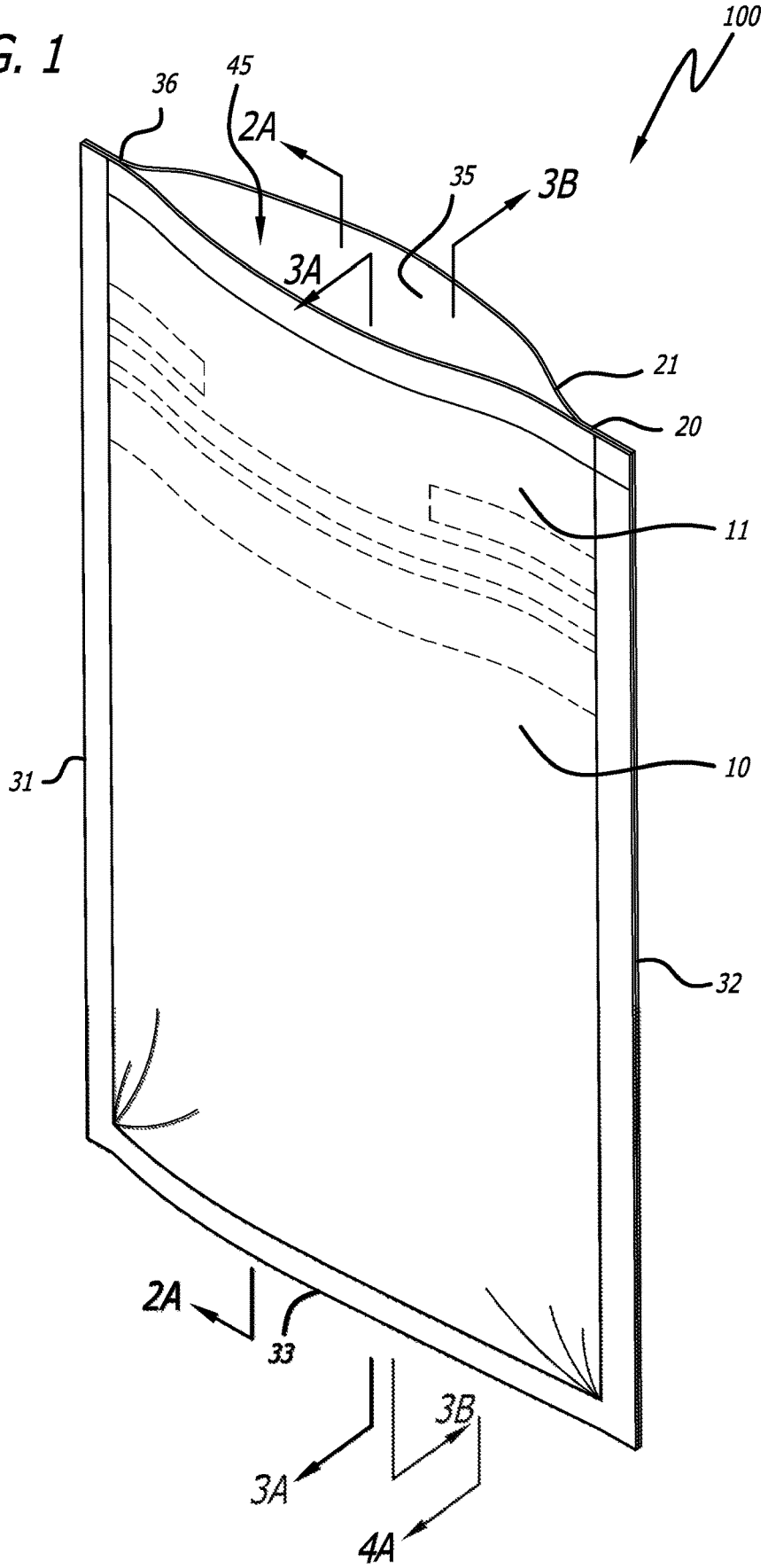
FIG. 1 is a perspective view of a resealable container in accordance with one embodiment.

Flexible packaging bags with resealable zipper closures are widely available for holding a variety of products. Zipper closures on conventional bags can be easily opened and are not appropriate for use with medicines and other potentially hazardous substances. Existing child-proof zipper systems are overly complicated and can be difficult and expensive to manufacture. It should be appreciated that there is a need for an improved child-resistant closure system. The present invention fulfills this need and provides further related advantages.

The present technology relates to a resealable container that is child-proof or child-resistant. In other words, the resealable container does not allow a person without knowledge of how to properly open the resealable container to open the resealable container and get access to content within the resealable container. The resealable container can employ a female and male interlocking members that must be properly rotated to cause the interlocking members to disengage (e.g., decouple). When a person without knowledge on how to properly open the resealable container attempts to open the resealable container in a sealed configuration, the interlocking members do not properly rotate to cause disengagement of the interlocking members. Alternatively, when a person with knowledge attempts to open the resealable container, the interlocking members can be properly rotated to cause the disengagement.

With reference to FIGS. 1-6 of the illustrative drawings, there is shown a resealable container 100 having a child-resistant closure system according to one embodiment. The resealable container 100 can include a first wall 10 and a second wall 20 opposing each other. The first and second walls 10, 20 can be sealed together (e.g., heat-sealed) along respective side edges 31, 32 and bottom edges 33 of the sealed first and second walls 10, 20 such that interior surfaces 34, 35 of the first and second walls 10, 20 form a storage space 40 therebetween. In one embodiment, each of the first wall 10 and the second wall 20 is made of a unitary sheet. A top edge 36 of the first wall 10 and a top edge 37 of the second wall 20 can define an opening 45 for the storage space 40. The first wall 10 and the second wall 20 can comprise respective interior surfaces 34, 35.

Although the resealable container 100 is shown as a rectangular form, it is understood that the resealable container 100 can have other forms. For example, the resealable container 100 can be triangular form, pentagonal form, hexagonal form, halfmoon-like form, or the like. The container 100 can comprise various materials, including thermoplastic films such as polyethylene. Different parts or portions of the resealable container 100 can be made of flexible, semi-flexible, semi-stiff, or stiff materials.

With particular reference to the perspective view of the resealable container 100 in FIG. 1, the resealable container 100 can provide an opening along an axis 2A. The inner surfaces 34, 35 of the respective first wall 10 and second wall 20 can be pulled apart at the top of the resealable container 100 along directions 3A and 3B to provide the opening 45. As the bottom of the resealable container 100 is sealed, attempts to open the resealable container 100 at or near the bottom edge 33 along axis 4A will fail.

Figure 2A:
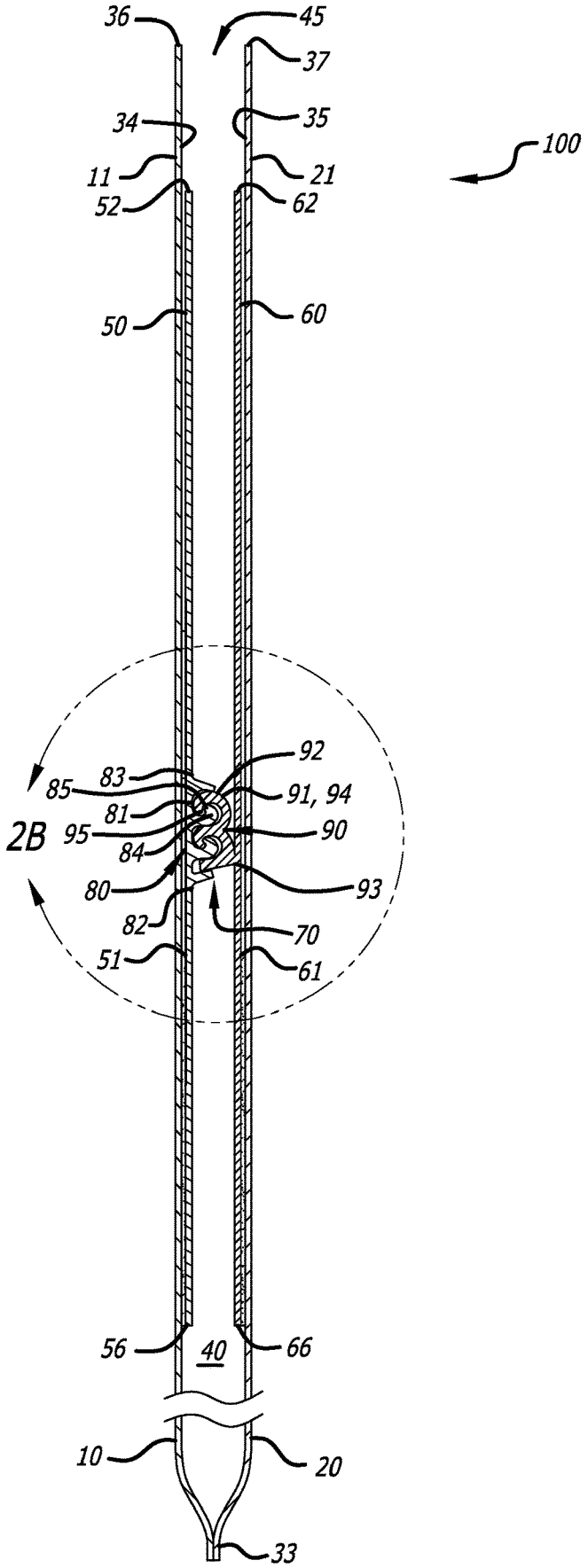
FIG. 2A is a cross-sectional side view of the resealable container of FIG. 1 showing a closure strip in a sealed configuration.
Figure 2B:
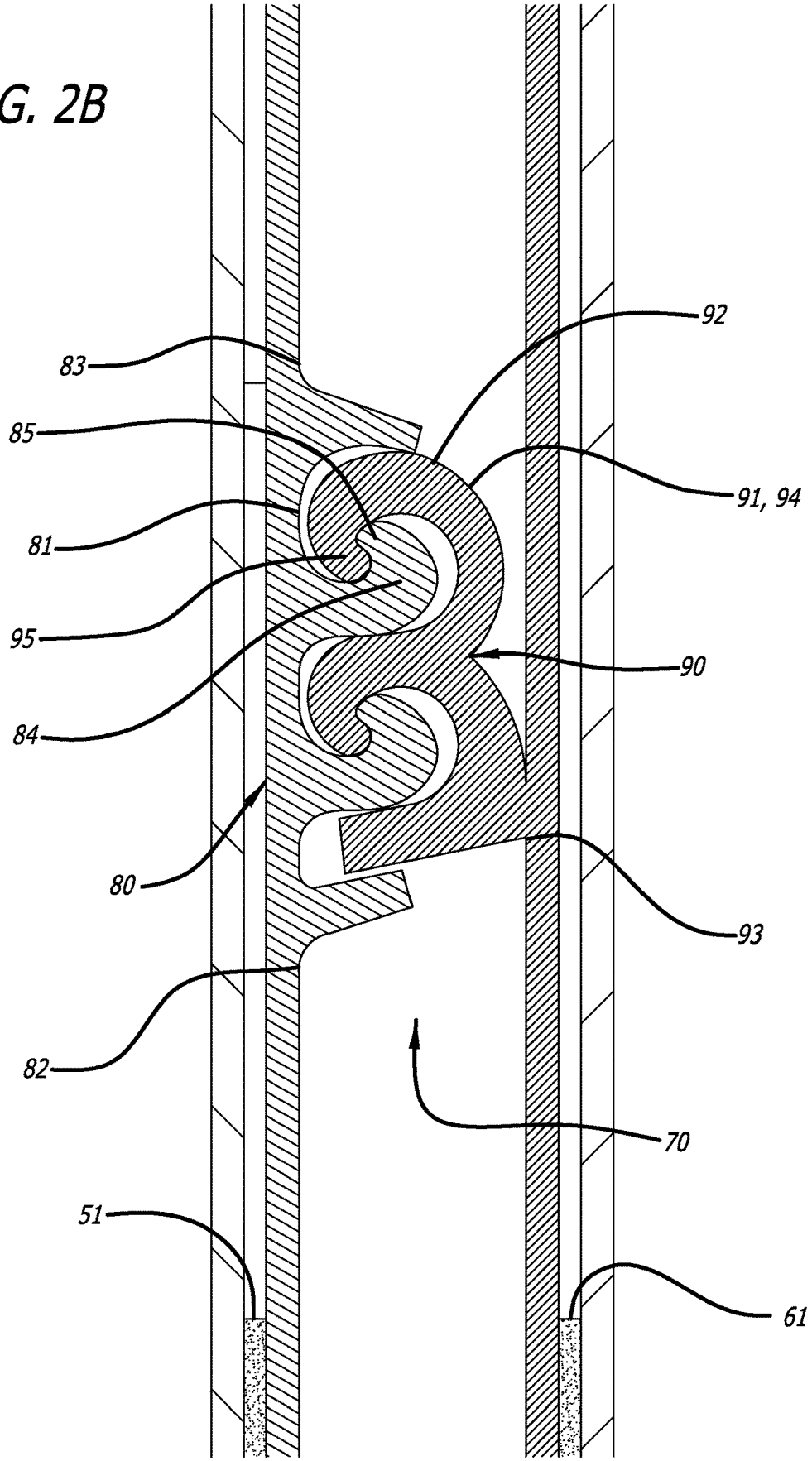
FIG. 2B is a detailed cross-sectional side view of the closure strip assembly from FIG. 2A.
Figure 3A:
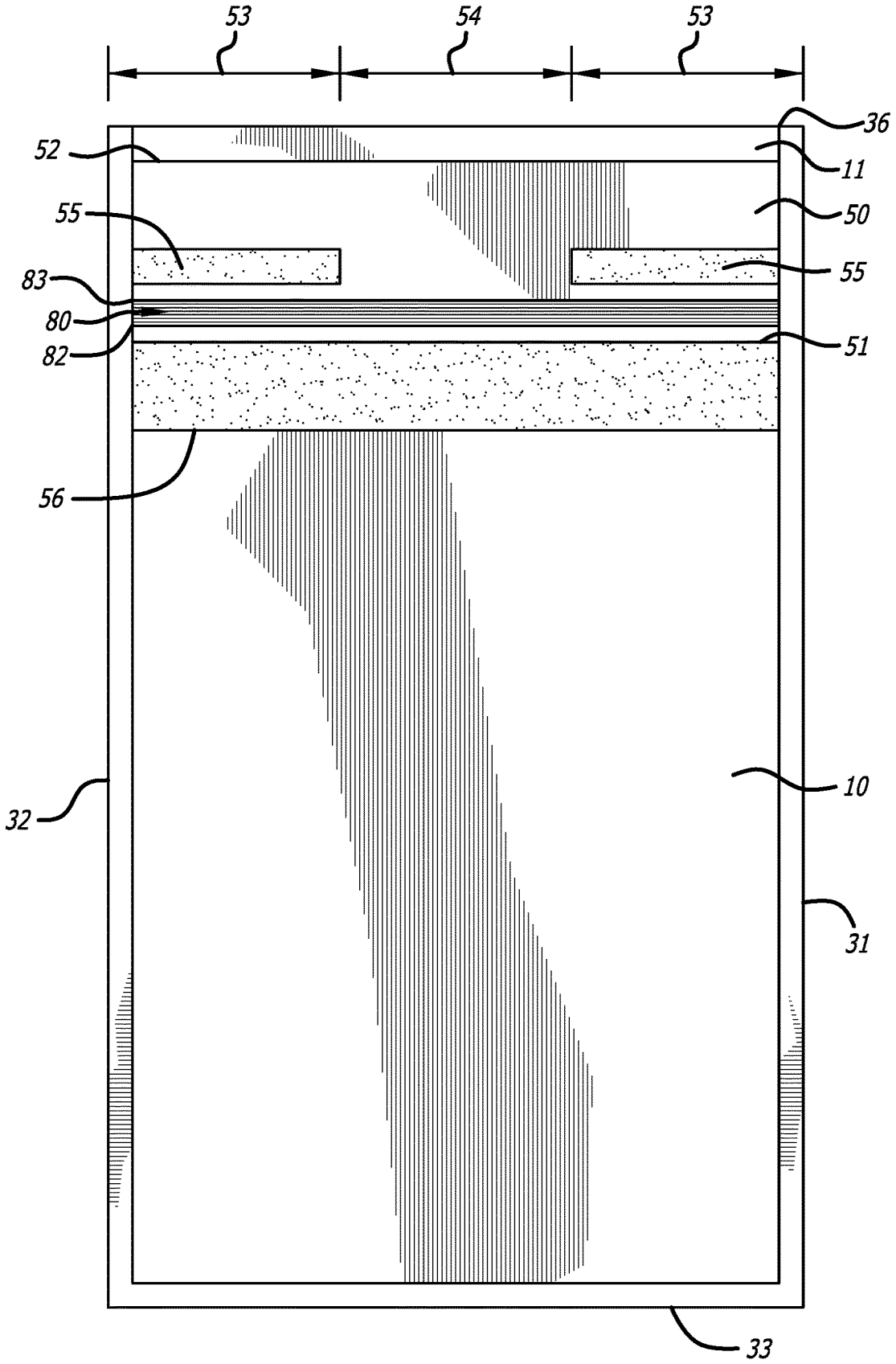
FIG. 3A is a cross-sectional front view of a first wall of the resealable container of FIG. 1.
Figure 3B:
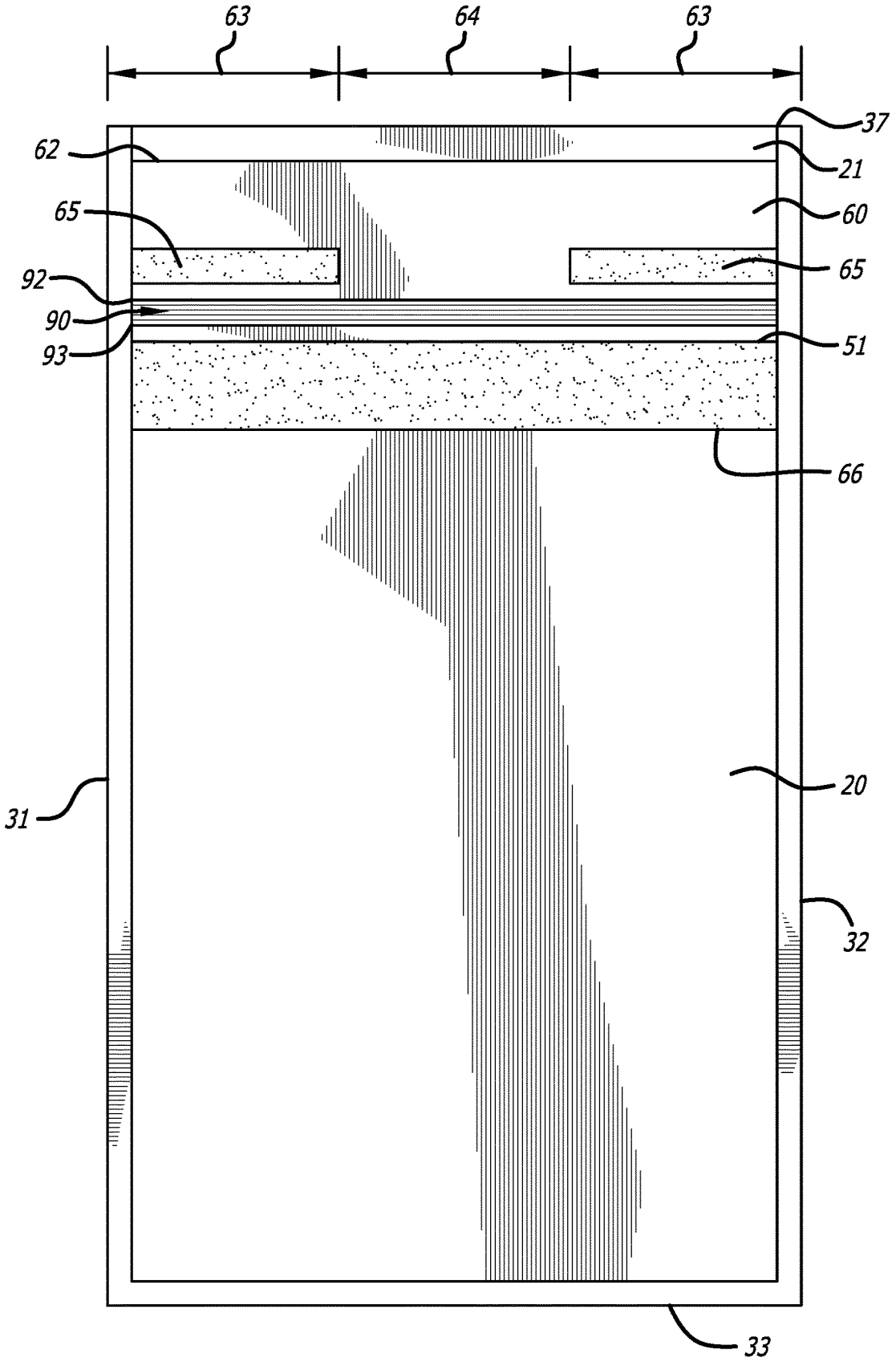
FIG. 3B is a cross sectional front view of a second wall of the resealable container of FIG. 1.

With particular reference to the cross-sectional side views of the resealable container 100 in FIGS. 2A and 2B, the resealable container 100 can further comprise a closure strip assembly 70. The closure strip assembly 70 can comprise a first lateral interlocking member 80 and a second lateral interlocking member 90. The interlocking members 80, 90 can be laterally positioned along an axis (e.g., the axis 2A of FIG. 1) as illustrated in FIGS. 3A and 3B. The first lateral interlocking member 80 can be mechanically coupled (e.g., engaged) with the second lateral interlocking member 90 to seal the opening 45 of the container 100 in a sealed configuration. Further, the first lateral interlocking member 80 can be mechanically decoupled (e.g., disengaged) from the second lateral interlocking member 90 to provide the resealable container 100 in an opened configuration that allows access into the opening 45. Operations of the interlocking members are further described in relation to FIGS. 5 and 6.

In one embodiment, the first lateral interlocking member 80 can comprise a top portion 83 and a bottom portion 82 opposite the top portion 83 of the first lateral interlocking member 80. In some embodiments, both the top and bottom portions 83, 82 of the first lateral interlocking member 80 can be attached to a first extension strip 50.

The first extension strip 50 can comprise a first edge 51 and a second edge 52. The first edge 51 and the second edge 52 can be termed "edges" as they can be seen in FIG. 3A along the axis 2A in FIG. 1 of the resealable container 100. The first edge 51 of the first extension strip 50 can be attached to the interior surface 34 of the first wall 10 below the top edge 36 of the first wall 10. The second edge 52 of the first extension strip 50 can be at a location between the first edge 51 of the first extension strip 50 and the top edge 36 of the first wall 10. The first edge 51 of the first extension strip 50 can define a portion of the interior surface 34 of the first wall 10 and a portion of the first extension strip 50 that are attached to each other below the first lateral interlocking member 80.

Figure 4:
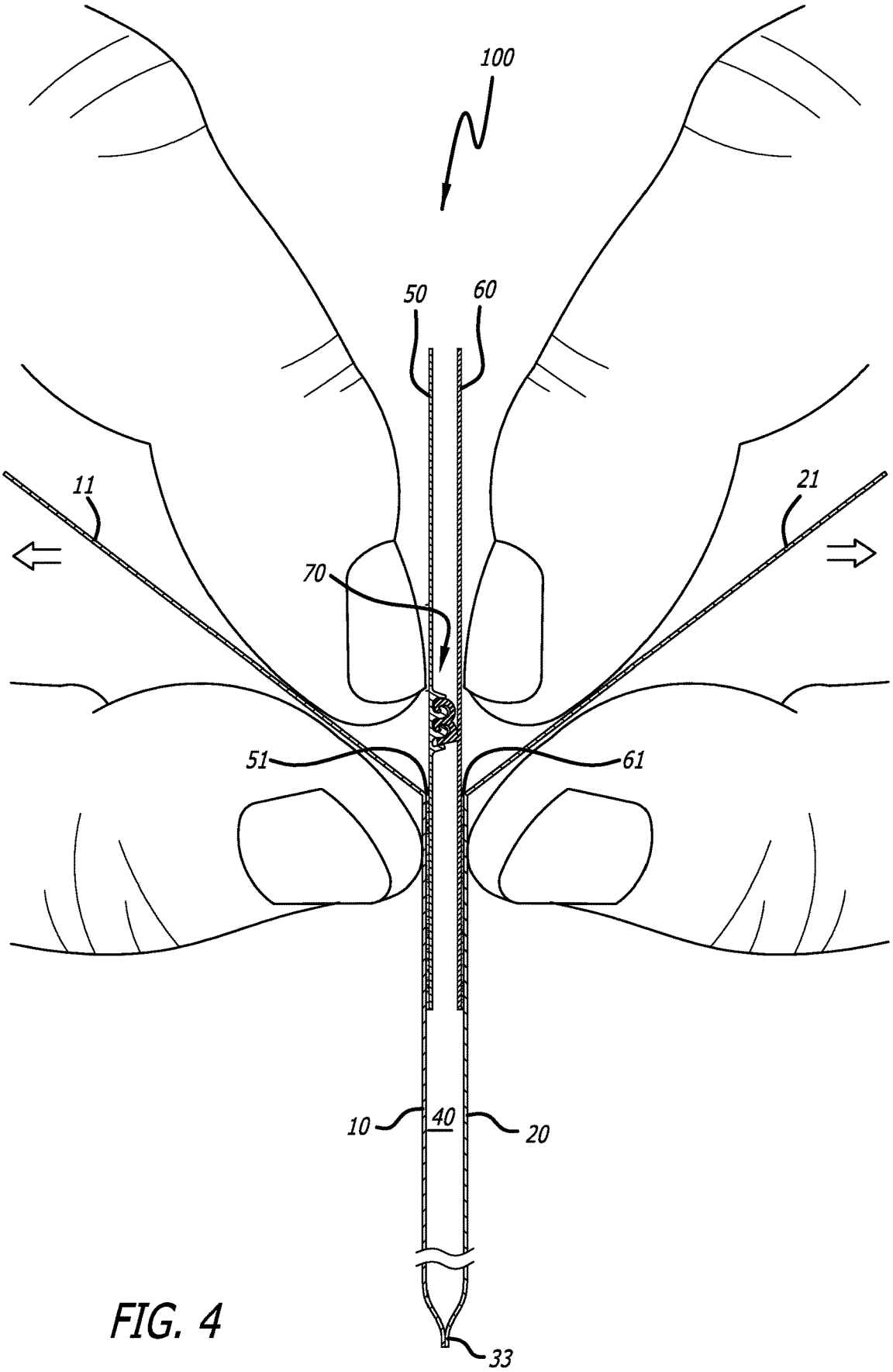
FIG. 4 is a cross-sectional side view of the resealable container of FIG. 1 shown grasped by a user for opening.
Figure 5:
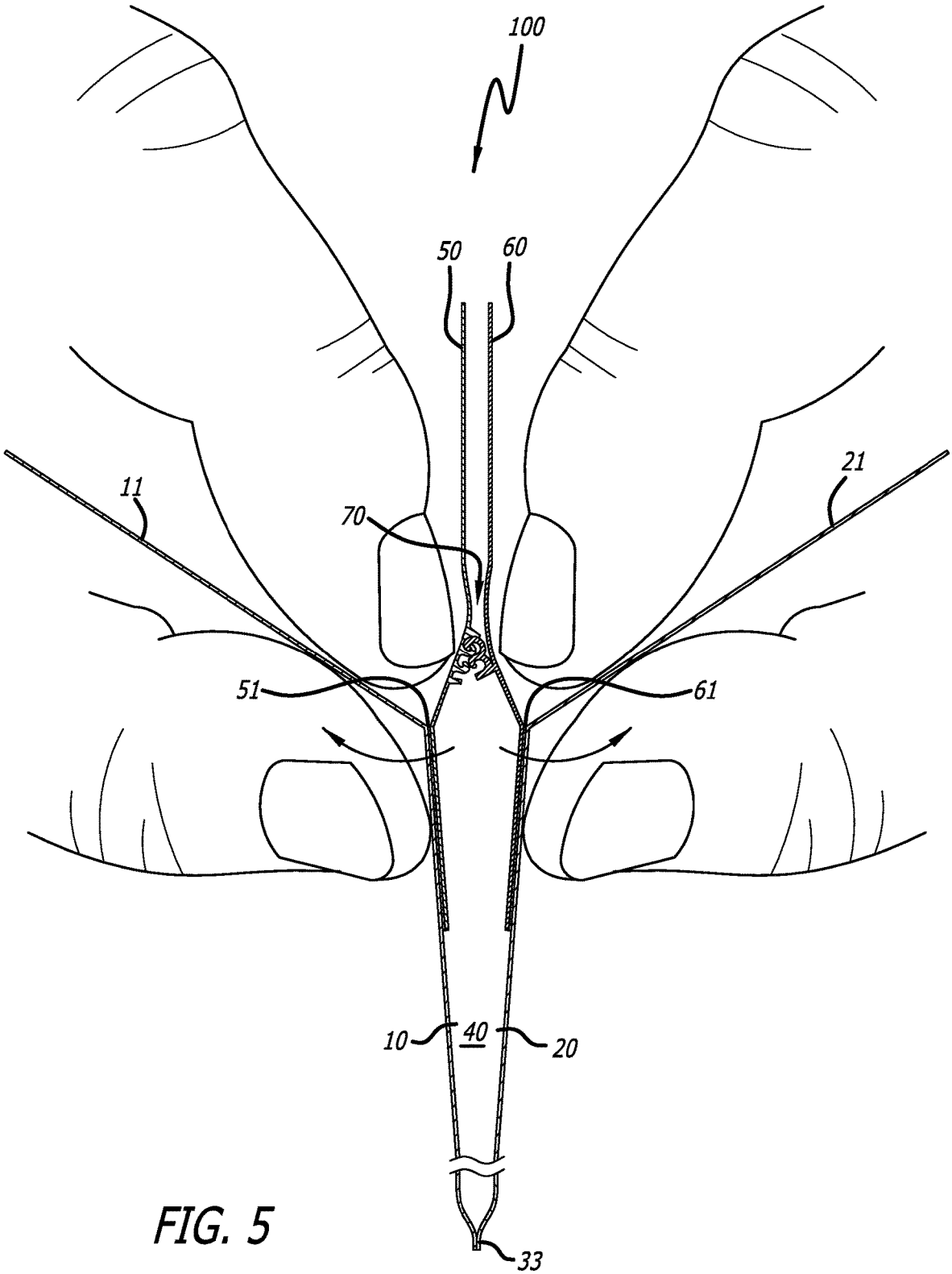
FIG. 5 is a cross-sectional side view of the resealable container of FIG. 1 showing the closure strip assembly in an opened configuration following a correct opening attempt.

A portion of the first wall 10 that extends above the first edge 51 to the top edge 36 can define a first flap 11 of the first wall 10. The second edge 52 of the first extension strip 50 can define a portion of the first extension strip 50 from the first edge 51 of the first extension strip 50 toward the top edge 36 of the first wall 10. The portion of the first extension strip 50 between the first edge 51 and the second edge 52 is not attached to the inner surface 34 of the first wall 10. Accordingly, the first flap 11 and at least the detached portion of the first extension strip 50 can be separated. For example, FIGS. 4 and 5 illustrate the detached portion of the first extension strip 50 separated from the first flap 11.

In one embodiment, the second lateral interlocking member 90 can comprise a top portion 92 and a bottom portion 93 opposite the top portion 92 of the second lateral interlocking member 90. In some embodiments, the bottom portion 93 of the second lateral interlocking member 90 can be directly attached to a second extension strip 60, but the top portion 92 of the second lateral interlocking member 90 may not be directly attached to the second extension strip 60. second lateral interlocking member 90 can be coupled to a second extension strip 60 at the bottom portion 93 of the second lateral interlocking member 90, and the top portion 92 of the second lateral interlocking member 90 can be rotatable, which is not coupled to the second extension strip 60 or to the interior surface 35 of the second wall 20. As the bottom portion 93 can be directly attached to the second extension strip 60 but the top portion 92 may not be, when the resealable container 100 is attempted to be opened by an outward separating force applied to the first flap 11 and the second flap 21 along axes 3A and 3B of FIG. 1, the outward separating force can cause the top portion 92 to be rotated relative to the second extension strip 60 along a trajectory 2B of FIG. 2A.

The second extension strip 60 can comprise a first edge 61 and a second edge 62. The first edge 61 and the second edge 62 can be termed "edges" as they can be seen in FIG. 3B along the axis 2A in FIG. 1 of the resealable container 100. The first edge 61 of the second extension strip 60 can be attached to the interior surface 35 of the second wall 20 below the top edge 37 of the second wall 20. The second edge 62 of the second extension strip 60 can be at a location between the first edge 61 of the second extension strip 60 and the top edge 37 of the second wall 20. The first edge 61 of the second extension strip 60 can define a portion of the interior surface 35 of the second wall 20 and a portion of the second extension strip 60 that are attached to each other below the second lateral interlocking member 90.

A portion of the second wall 20 that extends above the first edge 61 to the top edge 37 can define a second flap 21 of the second wall 20. The second edge 62 of the second extension strip 60 can define a portion of the second extension strip 60 from the first edge 61 of the second extension strip 60 toward the top edge 37 of the second wall 20. The portion of the second extension strip 60 between the first edge 61 and the second edge 62 is not attached to the inner surface 35 of the second wall 20. Accordingly, the second flap 21 and at least the detached portion of the second extension strip 60 can be separated. For example, FIGS. 4 and 5 illustrate the detached portion of the second extension strip 60 separated from the second flap 21.

With particular reference to the cross sectional front views of the resealable container 100 in FIGS. 3A and 3B, in one embodiment, the first lateral interlocking member 80 can be attached to the first extension strip 50 above the first edge 51 of the first extension strip 50 and below the second edge 52 of the first extension strip 50. Similarly, the second lateral interlocking member 90 can be attached to the second extension strip 60 above the first edge 61 of the second extension strip 60 and below the second edge 62 of the second extension strip 60. In one embodiment, a portion of the first extension strip 50 between the first lateral interlocking member 80 and the first edge 51 of the first extension strip 50 is not attached to the first wall 10. Likewise, a portion of the second extension strip 60 between the second lateral interlocking member 90 and the first edge 61 of the second extension strip is not attached to the second wall 20.

When referring to an "edge", the "edge" is referred to as an "edge" because it is attached to a wall to define an attachment edge for an extension strip. For example, the first edge 51 of the first extension strip 50 is attached to the first wall 10 to define an attachment edge for the first extension strip 50. However, it should be understood that first and second extension strips 50, 60 can include material that extends below these attachment edges 51, 61, as illustrated by portions 56 and 66, respectively.

With particular reference to the cross sectional front view of the resealable container 100 in FIG. 3A, the first extension strip 50 can further comprise peripheral segments 53 proximate the respective side edges 31, 32 of the first wall 10, and a central segment 54 between the peripheral segments 53. In some embodiments, a portion 55 of each of the peripheral segments 53 of the first extension strip 50 can be attached to the first wall 10 above the first lateral interlocking member 80 of the closure strip assembly 70, but the central segment 54 of the first extension strip 50 may not be attached to the first wall 10 above the first edge 51 of the first extension strip 50. In a further embodiment, the attached portion 55 of each of the peripheral segments 53 of the first extension strip 50 can be heat-sealed to the first wall 10. In some embodiments, there can be additional attached portions 55 such that there are multiple central segments 54.

With particular reference to the cross sectional front view of the resealable container 100 in FIG. 3B, the second extension strip 60 can further comprise peripheral segments 63 proximate the respective side edges 31, 32 of the second wall 20, and a central segment 64 between the peripheral segments 63. In some embodiments, a portion 65 of each of the peripheral segments 63 of the second extension strip 60 can be attached to the second wall 20 above the second lateral interlocking member 90 of the closure strip assembly 70, but the central segment 64 of the second extension strip 60 may not be attached to the second wall 20 above the first edge 61 of the second extension strip 60. In a further embodiment, the attached portion 65 of each of the peripheral segments 63 of the second extension strip 60 can be heat-sealed to the second wall 20.

Such embodiments can create pockets in the central segments 54, 64, which may guide the user's thumbs between the first and second flaps 11, 21 and the central segments 54, 64 of the first and second extension strips 50, 60. In addition, these embodiments can facilitate opening by increasing the rigidity of the first and second extension strips 50, 60 along the peripheral segments 53, 63 and concentrating the user's opening forces onto the first edges 51, 61 of the first and second extension strips 50, 60 within the central segments 54, 64.

In other embodiments, the second edge 52 of the first extension strip 50 is not attached to the interior surface 34 of the first wall 10, and the second edge 62 of the second extension strip 60 is not attached to the interior surface 35 of the second wall 20.

With particular reference again to the detailed cross-sectional side view of the resealable container 100 in FIG. 2B, in one embodiment, the first lateral interlocking member 80 can comprise at least three asymmetrical female strips or channels 81, and the second lateral interlocking member 90 can comprise at least three asymmetrical male strips or beads 91. At least one of the at least three asymmetrical female channels 81 can comprise a first J-shaped member 84, and at least one of the at least three asymmetrical male beads 91 can comprise a second J-shaped member 94. The first J-shaped member 84 and the second J-shaped member 94 can face opposite directions. For example, as illustrated in FIG. 2B, the first J-shaped member 84 can face the top edge 36 of the first wall 10, and the second J-shaped member 94 can face the bottom edge 33 of the second wall 20.

The first J-shaped member 84 can engage the second J-shaped member 94 when the first lateral interlocking member 80 is operatively connected to the second lateral interlocking member 90 in a sealed configuration. When the first lateral interlocking member 80 and the second lateral interlocking member 90 are engaged, the members 80, 90 cannot be disengaged without going through a proper disengagement process. Accordingly, the closure strip assembly 70 can provide child-resistance for the resealable container 100.

The first and second lateral interlocking members 80, 90 can be operable to disengage each other when the female interlocking strip 81 is caused to rotate relative to the male interlocking strip 91 so that the first J-shaped member 84 disengages from the second J-shaped member 94 in an opened configuration. For example, the first and second lateral interlocking members 80, 90 can be operable to disengage each other when the female interlocking strip 81 is caused to rotate relative to the male interlocking strip 91 so that a free end 85 of the first J-shaped member 84 rotates toward the bottom edge 33 of the first wall 10 (e.g., counter-clockwise in FIG. 2B) and a free end 95 of the second J-shaped member 94 rotates toward the bottom edge 33 of the second wall 20 (e.g., counter-clockwise in FIG. 2B).

With particular reference to the cross-sectional side views of the resealable container 100 in FIGS. 4 and 5, the first and second lateral interlocking members 80, 90 described above are configured to become disengaged (e.g., disconnected) from each other when the first flap 11 and the second flap 21 are pulled apart from each other. In one embodiment, a thumb of a user can be inserted between the first extension strip 50 and the first flap 11 of the first wall 10 to grip the first flap 11 but not the first extension strip 50. Similarly, the opposing thumb of the user can be inserted between the second extension strip 60 and the second flap 21 of the second wall 20 to grip the second flap 21 but not the second extension strip 60. The first and second flaps 11, 21 are gripped below the closure strip assembly 70 so that the user can pull the first flap 11 and the second flap 21 apart to cause the first edges 51, 61 of the first and second extension strips 50, 60 to separate outward. Outward opening force with respect to the first flap 11 and the first extension strip 50 can be concentrated at the bottom portion of the first lateral interlocking member 80. Likewise, the outward opening force with respect to the second flap 21 and the second extension strip 60 can be concentrated at the bottom portion 93 of the second lateral interlocking member 90. Thus, relative rotation between the first and second lateral interlocking members 80, 90 is maximized in the illustrated proper opening attempt. Opening the resealable container 100 in this way allows the first and second lateral interlocking members 80, 90 to become disengaged from each other from the bottom up. In other words, pulling the first and second flaps 11, 21 apart from each other as they are gripped below the closure strip assembly 70 allows the male and female interlocking strips 81, 91 to become disengaged from each other, one by one, from the bottom to the top of the closure strip assembly 70. Once disengaged, the resealable container 100 is provided in an opened configuration that provides access the user access into the storage space 40. In one embodiment, inward force applied on the first extension strip 50 toward the axis 3B of FIG. 1 and opposing inward force applied on the second extension strip 60 toward the axis 3A of FIG. 1 above the first and second lateral interlocking members 80, 90 may further assist the disengagement.

Figure 6:
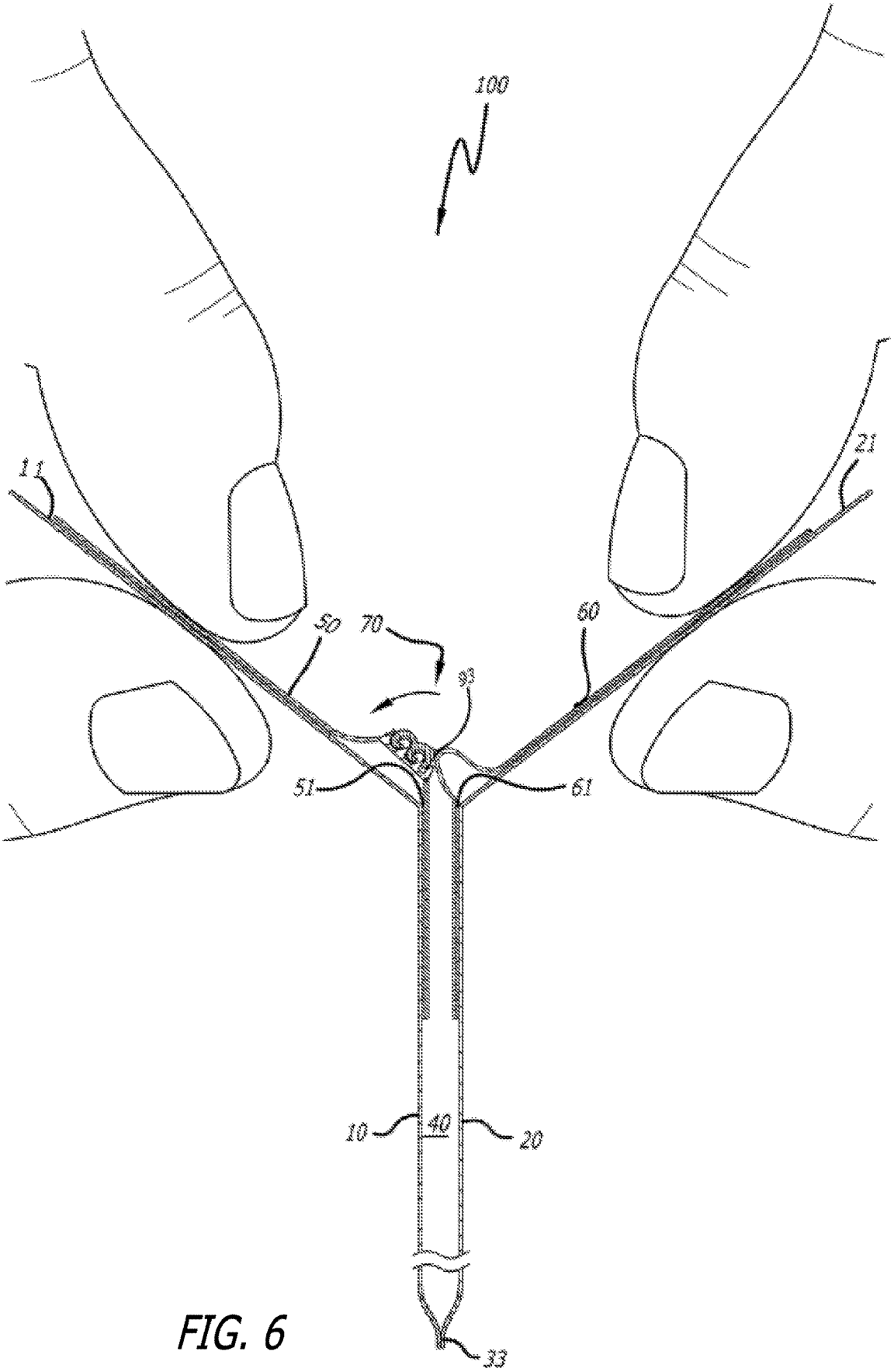
FIG. 6 is a cross-sectional side view of the resealable container of FIG. 1 showing an incorrect opening attempt on the resealable container.

In contrast, with particular reference to the cross-sectional side view of the resealable container 100 of FIG. 6, the first and second lateral interlocking members 80, 90 described above are configured to remain operatively connected (e.g., remain in a sealed configuration) when a user attempts to improperly open the resealable container 100. As described with respect to FIG. 5, to properly open the resealable container 100, a user is to grip between a flap and a corresponding extension strip. In contrast, if a user grips the flap and the corresponding strip together when attempting to open the resealable container 100, the closure strip assembly 70 resists disengagement (e.g., remains engaged). For instance, in FIG. 6, a user grips both the first flap 11 and the first extension strip 50 together. Likewise, the user grips both the second flap 21 and the second extension strip 60 together. Accordingly, thumbs of the user are positioned above the closure strip assembly 70 and applies outward opening force above the closure strip assembly 70. The outward opening force with respect to the first flap 11 and the first extension strip 50 can be concentrated at the top portion of the first lateral interlocking member 80. The outward opening force with respect to the second flap 21 and the second extension strip 60 can be concentrated at the bottom portion 93 of the second lateral interlocking member 90. Thus, relative rotation between the first and second lateral interlocking members 80, 90 is minimized in the illustrated improper opening attempt. The minimized relative rotation can be insufficient to disengage the first and second lateral interlocking members 80, 90 and, accordingly, prevents the resealable container 100 from providing access to content within the storage space 40.

It should be appreciated from the foregoing description that the present invention provides an improved child-resistant closure system.

Specific methods, devices, and materials are described, although any methods and materials similar or equivalent to those described can be used in the practice or testing of the present embodiment. Unless defined otherwise, all technical and scientific terms used herein have the same meanings as commonly understood by one of ordinary skill in the art to which this embodiment belongs. The terms "a," "an," and "at least one" encompass one or more of the specified element. That is, if two of a particular element are present, one of these elements is also present and thus "an" element is present. The terms "a plurality of" and "plural" mean two or more of the specified element. The term "or" used between the last two of a list of elements means any one or more of the listed elements. For example, the phrase "A, B, or C" means "A, B, and/or C," which means "A," "B," "C," "A and B," "A and C," "B and C," or "A, B, and C." The term "coupled" generally means physically coupled or linked and does not exclude the presence of intermediate elements between the coupled items absent specific contrary language. The term "vertical" refers to a direction from the top of the bag to the bottom of the bag, where the top is considered the location of the opening. The terms "lateral" and "horizontal" refer to the direction from side to side, which is generally orthogonal to the vertical direction. The terms "lower" and "below" refer to a direction toward the bottom of the bag and the terms "higher" and "above" refer to a direction toward the top of the bag.

Without further elaboration, it is believed that one skilled in the art, using the proceeding description, can make and use the present invention to the fullest extent. The invention has been described in detail with reference only to the presently preferred embodiments. Persons skilled in the art will appreciate that various modifications can be made without departing from the invention. Accordingly, the invention is defined only by the following claims.

The invention claimed is:

1. A resealable container comprising:

a first wall and a second wall, the first and second walls sealed together along respective side edges and bottom edges of the first and second walls such that interior surfaces of the first and second walls form a storage space therebetween, wherein a top edge of the first wall and a top edge of the second wall define an opening for the storage space;

a first extension strip having a first edge and a second edge, wherein the first edge of the first extension strip is attached to the interior surface of the first wall below the top edge of the first wall such that a portion of the first wall extends from the first edge of the first extension strip to the top edge of the first wall to define a first flap, and wherein the second edge of the first extension strip is positioned between the first edge of the first extension strip and the top edge of the first wall;

a second extension strip having a first edge and a second edge, wherein the first edge of the second extension strip is attached to the interior surface of the second wall below the top edge of the second wall such that a portion of the second wall extends from the first edge of the second extension strip to the top edge of the second wall to define a second flap, and wherein the second edge of the second extension strip is positioned between the first edge of the second extension strip and the top edge of the second wall; and a closure strip assembly comprising a first lateral interlocking member and a second lateral interlocking member, wherein:

the first lateral interlocking member is operatively connectable to the second lateral interlocking member, the first lateral interlocking member comprises at least three female interlocking channels, and the second lateral interlocking member comprises a top male interlocking bead at a top portion of the second lateral interlocking member, a bottom male interlocking bead at a bottom portion of the second lateral interlocking member, and a middle male interlocking bead located between the top male interlocking bead and the bottom interlocking bead;

wherein the second lateral interlocking member is attached to the second extension strip at the bottom portion of the second lateral interlocking member;

wherein the top portion of the second lateral interlocking member is unattached to the second extension strip; and wherein the first and second lateral interlocking members are configured to remain operatively connected when the first flap and the second flap are pulled apart while gripping the first flap together with the first extension strip and while gripping the second flap together with the second extension strip so as to cause the second edges of the first and second extension strips to be pulled apart from each other.

2. The resealable container of claim 1, wherein the first and second lateral interlocking members are configured to become disengaged from each other when the first flap and the second flap are pulled apart from each other as the first flap is gripped while the first extension strip is not gripped and the second flap is gripped while the second extension strip is not gripped so as to cause the first edges of the first and second extension strips to be pulled apart from each other.

3. The resealable container of claim 2, wherein the first and second lateral interlocking members are configured to become disengaged from each other when the first and the second flaps are gripped below the closure strip assembly.

4. The resealable container of claim 1, wherein the first lateral interlocking member is attached to the first extension strip above the first edge of the first extension strip and below the second edge of the first extension strip, wherein the second lateral interlocking member is attached to the second extension strip above the first edge of the second extension strip and below the second edge of the second extension strip, and wherein the first lateral interlocking member is operatively connectable to the second lateral interlocking member.

5. The resealable container of claim 4, wherein the first lateral interlocking member comprises a top portion and a bottom portion opposite the top portion of the first lateral interlocking member, and wherein the first lateral interlocking member is attached to the first extension strip at both the top and bottom portions of the first lateral interlocking member.

6. The resealable container of claim 2, wherein, when the first flap and the second flap are pulled apart from each other as the first flap is gripped while the first extension strip is not gripped and the second flap is gripped while the second extension strip is not gripped so as to cause the first edges of the first and second extension strips to be pulled apart from each other, outward opening force is concentrated at the bottom portion of the first lateral interlocking member and the bottom portion of the second lateral interlocking member such that relative rotation between the first lateral interlocking member and the second lateral interlocking member is maximized.

7. The resealable container of claim 6, wherein, when the first flap and the second flap are pulled apart while gripping the first flap together with the first extension strip and while gripping the second flap together with the second extension strip so as to cause the second edges of the first and second extension strips to be pulled apart from each other, outward opening force is concentrated at the top portion of the first lateral interlocking member and the bottom portion of the second lateral interlocking member such that relative rotation between the first lateral interlocking member and the second lateral interlocking member is minimized.

8. The resealable container of claim 1, wherein at least one of the at least three female interlocking channels comprises a first J-shaped member, and wherein at least one of the top, middle, and bottom male interlocking beads comprises a second J-shaped member.

9. The resealable container of claim 8, wherein the first J-shaped member faces the top edge of the first wall, and wherein the second J-shaped member faces the bottom edge of the second wall.

10. The resealable container of claim 8, wherein the first J-shaped member engages the second J-shaped member when the first lateral interlocking member is operatively connected to the second lateral interlocking member.

11. The resealable container of claim 8, wherein the first and second lateral interlocking members are operable to disengage each other when the first lateral interlocking member is rotated relative to the second lateral interlocking member so that the first J-shaped member disengages from the second J-shaped member.

12. The resealable container of claim 8, wherein the first and second lateral interlocking members are operable to disengage each other when the first lateral interlocking member is rotated relative to the second lateral interlocking member so that a free end of the first J-shaped member rotates toward the bottom edge of the first wall and a free end of the second J-shaped member rotates toward the bottom edge of the second wall.

13. The resealable container of claim 1, wherein:

each of the first extension strip and the second extension strip further comprises peripheral segments proximate the respective side edges of the first and second walls, and a central segment between the respective peripheral segments;

the peripheral segments of the first extension strip are attached to the first wall above the closure strip assembly, and wherein the central segment of the first extension strip is not attached to the first wall above the first edge of the first extension strip; and the peripheral segments of the second extension strip are attached to the second wall above the closure strip assembly, and wherein the central segment of the second extension strip is not attached to the second wall above first edge of the second extension strip.

14. The resealable container of claim 1, wherein a portion of the first extension strip between the first lateral interlocking member and the first edge of the first extension strip is not attached to the first wall.

15. The resealable container of claim 14, wherein a portion of the second extension strip between the second lateral interlocking member and the first edge of the second extension strip is not attached to the second wall.

16. The resealable container of claim 1, wherein each of the first wall and the second wall is made of a unitary sheet.

17. The resealable container of claim 1, wherein the second edge of the first extension strip is not attached to the interior surface of the first wall.

18. The resealable container of claim 17, wherein the second edge of the second extension strip is not attached to the interior surface of the second wall.

19. The resealable container of claim 1, wherein the at least three female interlocking channels are asymmetrical.

20. The resealable container of claim 19, wherein the top, middle, and bottom male interlocking beads are asymmetrical.

* * * * *